United States Patent [19]

Steckenrider

[11] 3,967,568

[45] July 6, 1976

[54] THREAD CUTTER FOR BLINDSTITCH SEWING MACHINE

[75] Inventor: Paul E. Steckenrider, Hoffman Estates, Ill.

[73] Assignee: Union Special Corporation, Chicago, Ill.

[22] Filed: May 31, 1974

[21] Appl. No.: 475,163

[52] U.S. Cl. ..... 112/252; 112/176

[51] Int. Cl.[2] ..... D05B 65/02

[58] Field of Search ..... 112/112, 128, 130, 252, 112/176, 177, 178

[56] References Cited

UNITED STATES PATENTS

| | | | |
|---|---|---|---|
| 2,550,611 | 4/1951 | Spaine | 112/252 |
| 3,186,367 | 6/1965 | Greco | 112/252 |
| 3,308,779 | 3/1967 | Winberg | 112/252 |
| 3,665,878 | 5/1972 | Koschoff et al. | 112/252 |
| 3,688,716 | 9/1972 | Heimann et al. | 112/252 |
| 3,747,548 | 7/1973 | Brophy et al. | 112/252 |

FOREIGN PATENTS OR APPLICATIONS

| | | | |
|---|---|---|---|
| 1,104,308 | 4/1961 | Germany | 112/252 |

*Primary Examiner*—Werner H. Schroeder
*Attorney, Agent, or Firm*—Diller, Brown, Ramik & Wight

[57] ABSTRACT

This disclosure relates to a thread cutter for effecting the cutting of a thread at the termination of a sewing action with a sewing machine. The thread cutter is particularly effective on synthetic threads, such as nylon and monofilament, which are more difficult to cut than cotton thread. The thread cutter includes a pair of relatively movable blades having a scissor action to produce an effective thread cutting operation. The thread cutter is very compact and does not require any bulky attachment on the arm of the machine, as is usually required.

17 Claims, 15 Drawing Figures

THREAD CUTTER FOR BLINDSTITCH SEWING MACHINE

This invention relates in general to new and useful improvements in sewing machine attachments, and more particularly to a novel thread cutter for use with a sewing machine.

Background of the Invention

It is conventional to provide a sewing machine with a thread cutter which operates at the end of a sewing cycle to cut the thread so that the stitched member may automatically be released from the sewing machine. These thread cutters, however, are either of the fixed type over which the thread is to be drawn, or constitute a single blade which is pivoted or otherwise moved into contact with the thread to effect the cutting thereof. Typical of patents disclosing such thread cutters are U.S. Pat. Nos. 2,172,494; 2,889,793; 3,186,367; 3,288,094; 3,308,779; 3,565,026; 3,661,104 and 3,665,878.

It has been found that thread cutters using a single movable blade do not effectively cut synthetic threads such as nylon and monofilaments, which threads are more difficult to cut than the conventional cotton thread. In some instances, the cutting of synthetic threads is enhanced by means of a thread clamp which clamps the thread in place while the blade is operative thereon.

Summary of the Invention

In view of the foregoing, and in accordance with this invention, there has been developed a thread cutter which utilizes two blades cooperable in a scissor-like action to effectively cut all threads, including synthetic threads. The scissor-type thread cutter of this invention provides for a more positive cutting action without requiring a thread clamp. Further, the thread cutter of this invention is very compact and does not require any bulky attachments on the arm of the machine, such as shown in some of the above-identified patents.

With the above and other objects in view that will hereinafter appear, the nature of the invention will be more clearly understood by reference to the following detailed description the appended claims and the several views illustrated in the accompanying drawings:

Figures 1, 6:
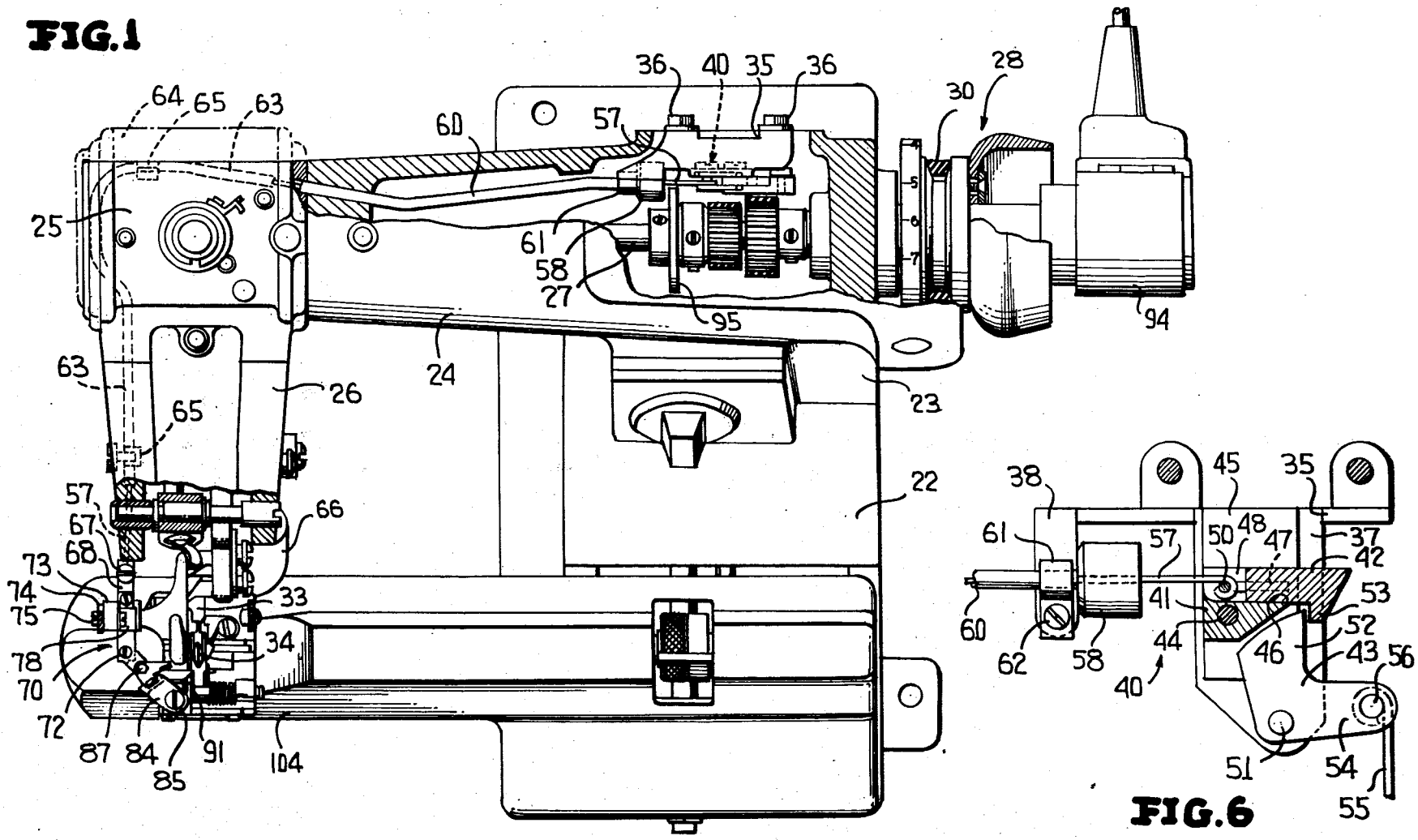
FIG. 1 is a top plan view of a blindstitch sewing machine head with parts broken away and shown in section, the sewing machine incorporating the thread cutter and thread cutter actuating mechanism of this invention.
FIG. 6 is a fragmentary elevational view of the thread cutter actuating mechanism removed from the machine head and appearing as viewed generally along the line 6-6 of FIG. 3.

Referring now to the drawings in detail, it will be seen that there is illustrated a sewing machine head, generally identified by the numeral 20 which includes a machine frame, generally identified by the numeral 21. The machine frame 21 includes a base portion 22, a vertical standard 23 rising upwardly from the base portion, a horizontally extending overhanging arm 24 projecting from the upper end of the vertical standard and having at its free end a head portion 25 from which there extends forwardly and slightly downwardly an arm 26.

Figure 3:
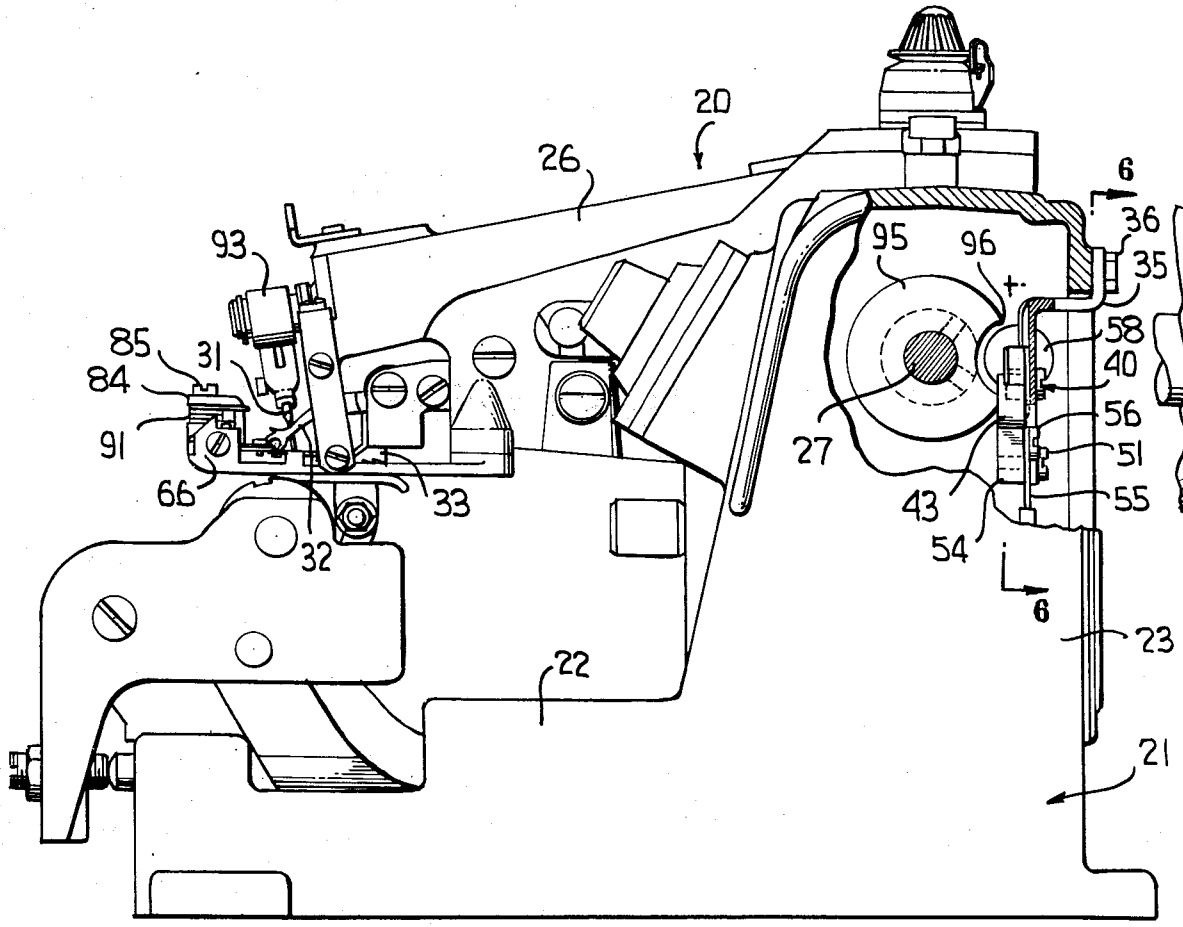
FIG. 3 is an elevational view of the right end of the machine of FIG. 1 with parts broken away and in section and again showing the thread cutter actuating mechanism.

With particular reference to FIGS. 1 and 3, it will be seen that a main drive shaft 27 is suitably journalled in the overhanging arm 24 and extends horizontally into and through the vertical standard 23. At its right end, the shaft 27 extends beyond the vertical standard 23 and carries a combination hand wheel pulley, generally identified by the numeral 28, by which the machine is driven through a belt 30 from a suitable conventional transmitter (not shown).

At its left end, the main shaft 27 extends into the head 25 and carries means for driving a needle 31, looper 32 and feed dog 33. These means and their operation are conventional and are disclosed in the patent to Roth, et. al. U.S. Pat. No. 3,288,094 and the patent to Fletcher, et al. U.S. Pat. No. 3,661,104.

It is to be understood that the machine head 20 also includes a node or ridge former 34 and conventional means for mounting and driving the same. The mounting means and driving means for the node former 34 will be identical to that disclosed in the Fletcher, et al. U.S. Pat. No. 3,661,104.

Referring now specifically to FIGS. 1, 2, 3 and 6, it will be seen that there is a bracket 35 which is secured by means of screws 36 to the upper rear part of the vertical standard 23. The bracket 35 has downwardly extending legs 37, 38 with the legs 37 being longer and wider than the leg 38, as is clearly shown in FIG. 6. Mounted on leg 37 is the main portion of the thread cutter actuating mechanism of this invention, the thread cutter actuating mechansim being generally identified by the reference numeral 40.

The thread cutter actuating mechanism 40 includes a guide block 41, a sliding cam follower 42 and an L-shaped cam member 43. The guide block 41 is fixedly secured by means of a screw 44 in a slot 45 formed in the bracket leg 37. The block 41 is provided with a guide slot 46 with each side of the slot 46 having elongated openings 47. The cam follower 42 is provided with a slot 48 at its left end (FIG. 6) and a pin 50 passes through the slot 48 and extends slightly beyond each side of the cam follower 42. The cam follower 42 is received in the guide slot 46 and the extending ends of the pin 50 are received in the openings 47.

It is to be understood that in the actual assembly of the cam follower 42 and the guide block 41, the cam follower 42 is placed in the slot 46 of the guide block 41 and then the pin 50 is passed through the opening 47 in one side of the slot 46, through the cam follower 42 and into the opening 47 on the other side of the slot 46. The openings 47 are slightly larger than the pin 50 so that the pin will slide freely whereas the pin 50 is tightly fitted in the cam follower 42.

Figure 2:
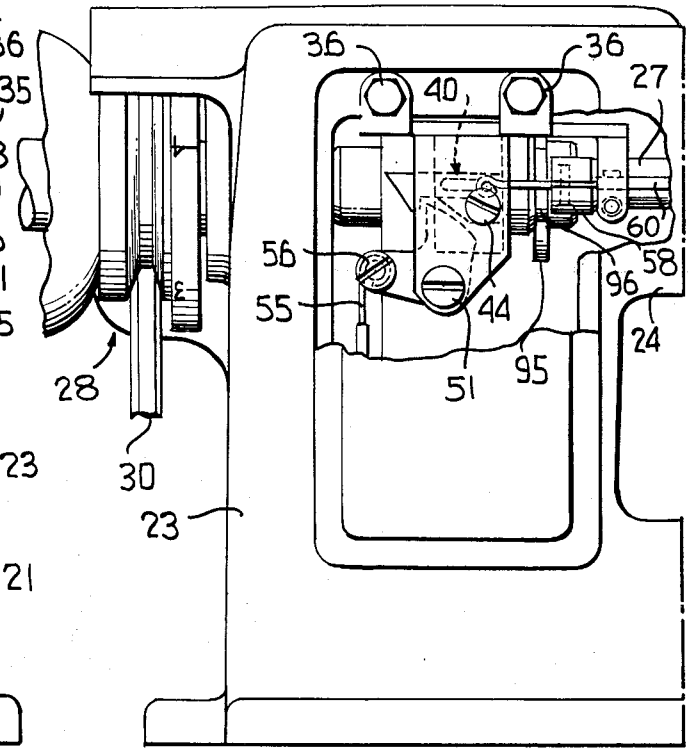
FIG. 2 is a fragmentary elevational view of the rear of the machine head of FIG. 1 and shows further the details of the thread cutter actuating mechanism.

The L-shaped cam member 43 is pivotally mounted by means of a shoulder screw 51 at the lower end of the bracket leg 37 (FIGS. 2 and 6). One arm 52 of the cam member 43 extends upwardly to cooperate with a downwardly extending portion 53 of the cam follower 42. A second arm 54 of the cam member 43 extends horizontally from the pivot defined by the shoulder screw 51 and has a rod 55 secured thereto at the end of the rod by means of a shoulder screw 56. The rod 55 extends downwardly to a suitable linkage and foot treadle which are conventional and not shown.

As is best shown in FIGS. 1, 2 and 6, one end of a wire 57 passes around the pin 50 and extends horizontally towards the head 25. A stop plug 58 is clamped to the wire 57 between the legs 37,38 of the bracket 35. The stop plug is in contact with the bracket leg 38 when the thread cutter actuating mechanism 40 is in its rest position. The wire 57 then passes through a solid tube 60 which is fastened at one of its ends to the bracket leg 38 by means of a clamp 61 and a screw 62. The other end of the tube 60 passes through the left end wall of the overhanging arm 24.

Figure 5:
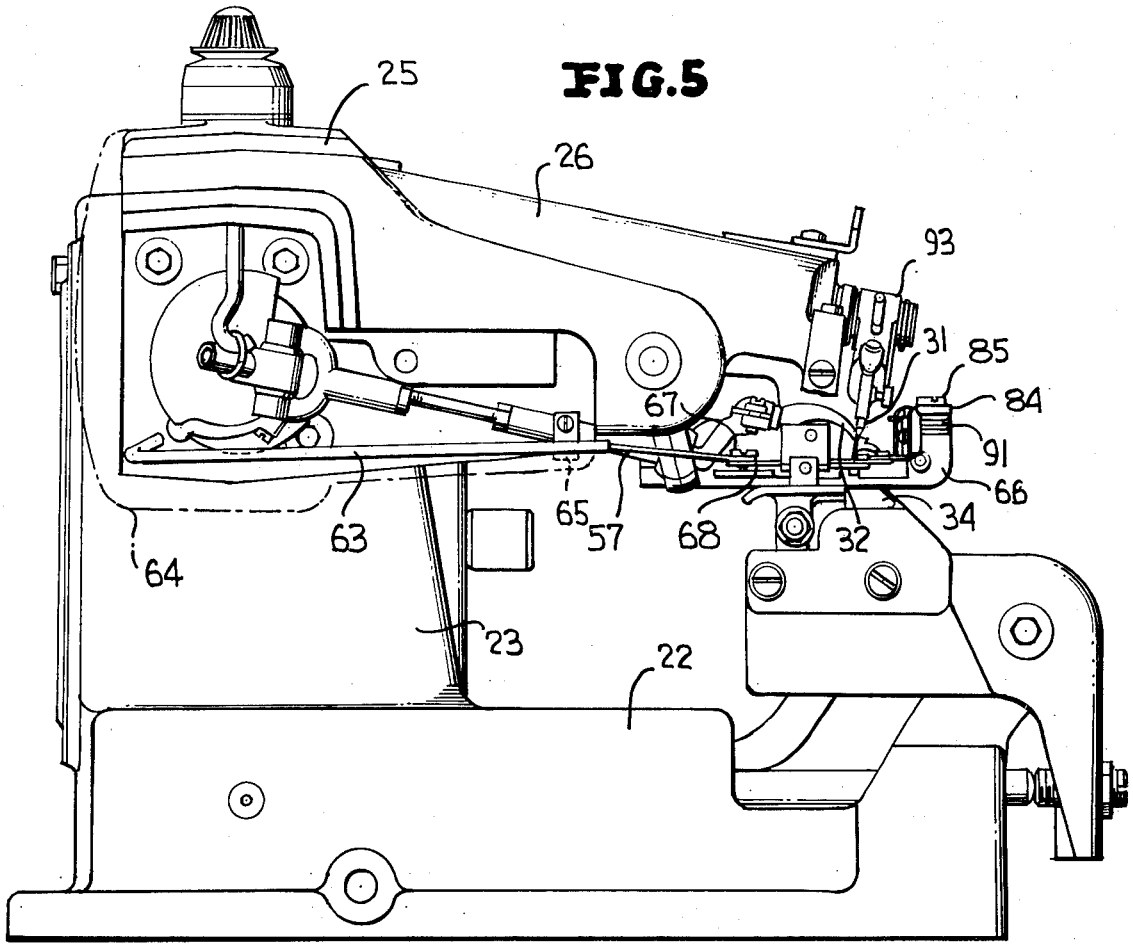
FIG. 5 is a fragmentary elevational view from the left end of the machine and shows a portion of the thread cutter mechanism.

A second tube 63 (FIG. 1) passes around the inside of a cover 64 for the head, the cover 64 being illustrated in phantom lines in FIGS. 1 and 5, and the tube 63 is fastened in place by means of clamps 65 secured both to the head portion 25 and the arm 26. The wire 57 continues to pass through the second tube 63 and finally extends beyond the tube 63 in the area of a presser foot 66.

Figure 7:
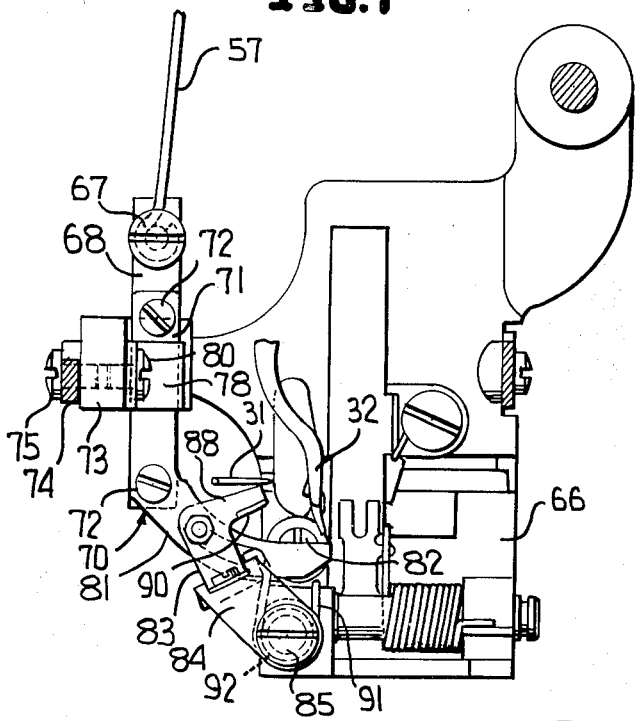
FIG. 7 is an enlarged fragmentary top plan view of the presser foot portion of the sewing machine with the thread cutter shown in its inoperative position.
Figure 8:
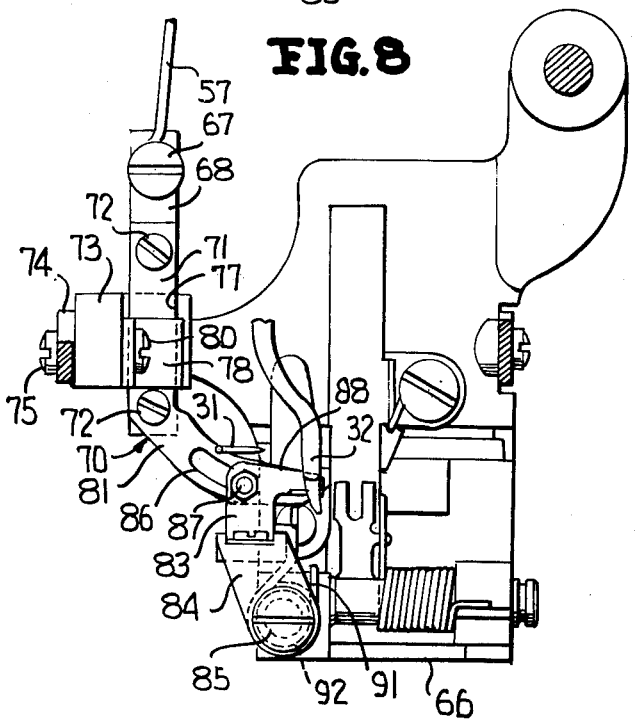
FIG. 8 is an enlarged fragmentary top plan view similar to FIG. 7 and shows the thread cutter in its operative position.

Referring now to FIGS. 1, 7 and 8, it will be seen that the end wire 57 is fastened by means of a shoulder screw 67 to the upper end of a lower knife carrier plate 68. A lower knife 70 has a rear end portion 71 fastened to the other end of the carrier plate 68 by means of screws 72. The lower knife 70 and the carrier plate 68 are slidably guided in a guide block 73 which is fixedly secured to a left presser foot bracket 74 by means of a screw 75.

Figure 11:
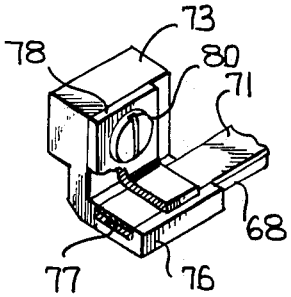
FIG. 11 is a perspective view with parts broken away and in section showing the mounting and guiding means for the lower blade.
Figure 9:
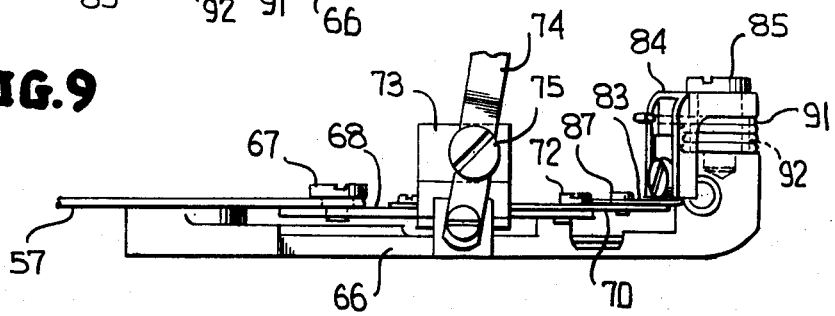
FIG. 9 is an enlarged fragmentary view of the presser foot and thread cutter taken from the left side of FIG. 7.

As is best shown in FIG. 11, the guide book 73 is of a generally L-shaped configuration and includes a lower leg 76 having a slot 77 formed in the upper surface thereof. The mounting plate 68 and the rear portion 71 of the knife 70 are held in the slot 77 by a bracket 78 which is secured to a vertically extending portion of the block 73 by means of a screw 80.

Figure 10:
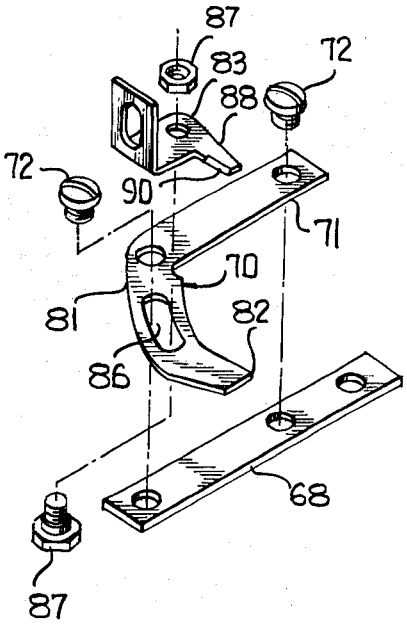
FIG. 10 is an exploded perspective view of the thread cutting blades.

As is best shown in FIG. 10, the lower knife 70 is of a generally L-shaped configuration and includes a slightly curved front portion 81 which extends forwardly and to the right and ends with a cutting edge 82 thereof above the left side of the presser foot 66, as is shown in FIG. 7. An upper knife 83 is fixedly mounted on an L-shaped bracket 84 which, in turn, is pivotally mounted on a front portion of the presser foot 66 by means of a shoulder screw 85. The front curved portion 81 of the lower knife 70 is provided with an arcuate slot 86 through which extends a shoulder bolt and nut arrangement 87 which operatively connects together the lower knife 70 and the upper knife 83.

A right end 88 of the upper knife 83 is provided with a cutting edge 90 which cooperates with the cutting edge 82 of the lower knife 70 when the knives are actuated into their thread cutting positions. The knives 70 and 83 are held in a non-cutting or open position by means of a torsion spring 91 which, as is shown in FIG. 7, biases the upper knife 83 in a counterclockwise direction. The torsion spring 91 is carried by a spacer 92 which, in turn, is carried by the shoulder of shoulder screw 85 in between the pivotal bracket 84 and the presser foot 66.

Figure 4:
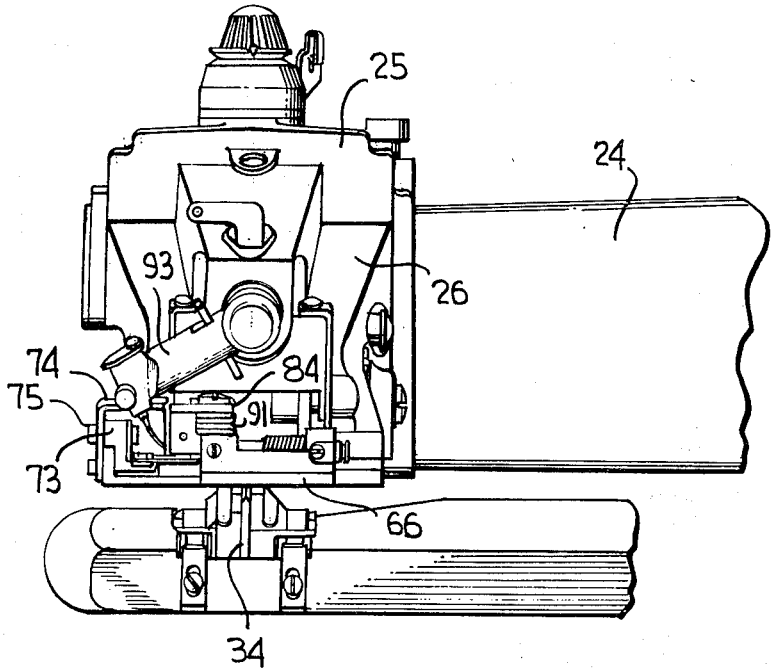
FIG. 4 is a fragmentary front elevational view of the left end portion of the machine of FIG. 1 and shows some of the details of the thread cutter mechanism.

With the thread cutting mechanism being mounted in the area immediately to the left of the presser foot 66, it has been found necessary to use a throw-out needle carrier 93, as is shown in FIGS. 3 – 5. The addition of the thread cutter does not allow enough clearance to thread the needle 31 or to change the needle if a conventional needle carrier were utilized. It is to be understood that the throw-out needle carrier 93 is a conventional needle carrier and is fully described in the Forte, et al. U.S. Pat. No. 3,606,849.

It is to be understood that a conventional needle positioner is employed in conjunction with the thread cutting mechanism of this invention. However, the only portion of the needle positioner that is specifically illustrated in the drawings is the synchronizer 94 which is fastened to the right end of the main shaft 27, as is shown in FIG. 1.

In operation, an operator, at the end of a garment seam, will allow the conventional foot treadle (not shown) to return to the neutral null position. This stops the operation of the machine with the needle 31 and the looper 32 in the position shown in the drawings. It also stops a notched disc 95 (FIGS. 1 and 3) which is fastened to the main shaft 27, in the position shown in FIG. 3. This disc 95 acts as a safety feature in conjunction with the stop lug 58. If the notch 96 in the disc 95 is not lined up with the stop lug 58, the actuating mechanism 40 cannot operate the thread cutter.

Figure 12:
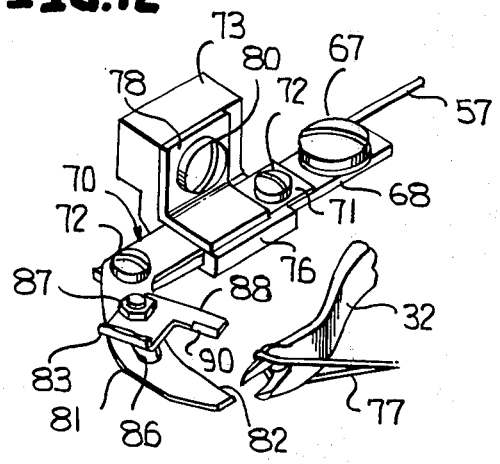
FIG. 12 is a perspective view showing the relationship of the thread cutter, the looper and the thread at the time the machine is stopped.

After the machine has stopped with the needle 31, the looper 32 and the notched disc 95 in the correct position, the machine operator then heels the control treadle. Through a linkage not shown and the rod 55, the cam member 43 is rotated in a clockwise direction as is shown in FIG. 6. The portion 52 of the cam member 43 contacts the portion 53 of the cam follower 42 and begins to move the cam follower 42, the wire 57 and the stop lug 58 towards the right as viewed in FIGS. 1 and 6. From FIG. 1, it will be apparent that as the end of the wire 57 which is connected to the cam follower 42 is moved to the right, the other end of the wire 57, that is attached to the lower carrier plate 68, will pull the plate 68 and the lower knife 70 towards the looper 32. At this time, the thread loop from the last stitch is carried about the fingers of the looper 32, as is shown in FIG. 12, and the thread 77 is in a taut condition.

Figure 13:
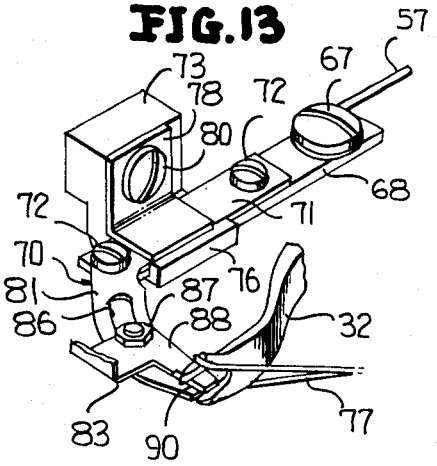
FIG. 13 is a view similar to FIG. 12 showing the position of the thread cutter as it cuts the thread.

As the lower knife 70 moves back towards the looper 32, the arcuate slot 86, in combination with the shoulder bolt and nut arrangement 87, causes the upper knife 83 to rotate in a clockwise direction, as viewed in FIGS. 7 and 8, towards the looper 32. As the lower knife 70 continues to move back, the knives 70 and 83 come together between the fingers of the looper 32 in a scissor action and cut that portion of the thread loop 77 that passes around the fingers of the looper 32 in the manner shown in FIG. 13.

Referring once again to FIG. 6, it is to be understood that by the time the thread 77 is cut, the cam member 43 has rotated to a position where the portion 52 thereof is no longer in contact with the cam follower 42 and thus no longer applies a tension to the wire 57 urging the same to the right in FIG. 6. Accordingly, the torsion spring 91 is effective to rotate the upper knife 83 in a counterclockwise direction and, in turn, the lower knife 70 is pulled forward, pulling the wire 57 which, in turn, pulls the cam follower 42 to the left in FIG. 6 until the stop lug 58 contacts the bracket leg 38 and stops the thread cutter mechanism and the thread cutter actuating mechanism in their original positions. The operator now allows the threadle to return to its neutral position which, in turn, rotates the cam member 43 in a counterclockwise direction. As the cam member 43 rotates, it contacts the portion 53 of the cam follower 42 with the result that the cam follower is pushed upwardly and rotates about the pin 50 and allows the cam member 43 to return to its original position. After the cam member 43 passes back to its original position of FIG. 6, the cam follower 42 drops back to its original position simply by means of gravity.

The operator can now remove the previously stitched workpiece and insert a new workpiece.

Figure 14:
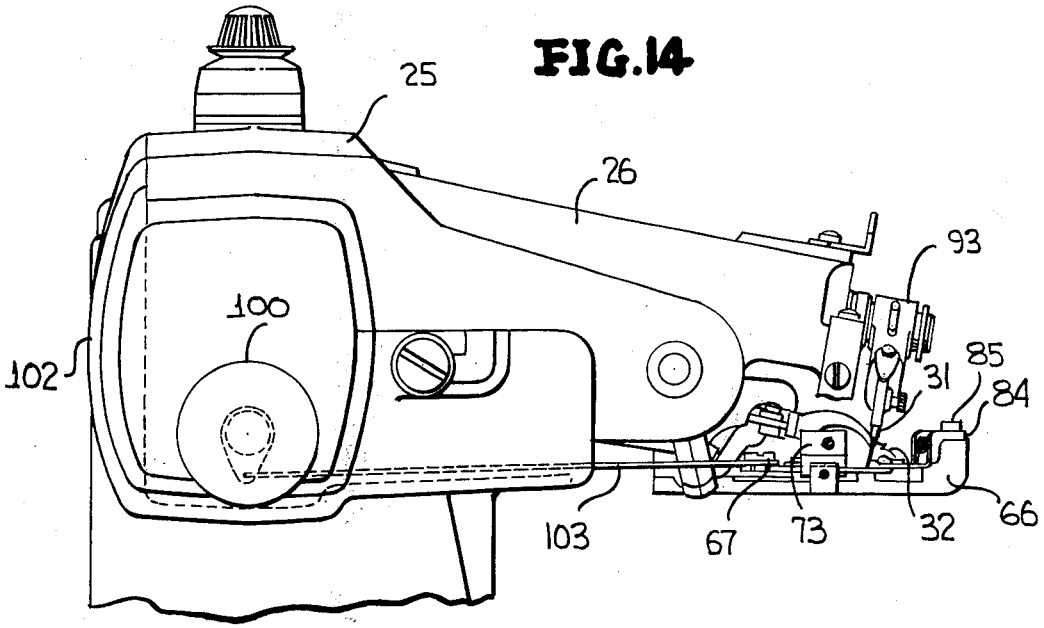
FIG. 14 is a partial elevational view somewhat similar to FIG. 5 and shows a modified form of thread cutter actuating mechanism.
Figure 15:
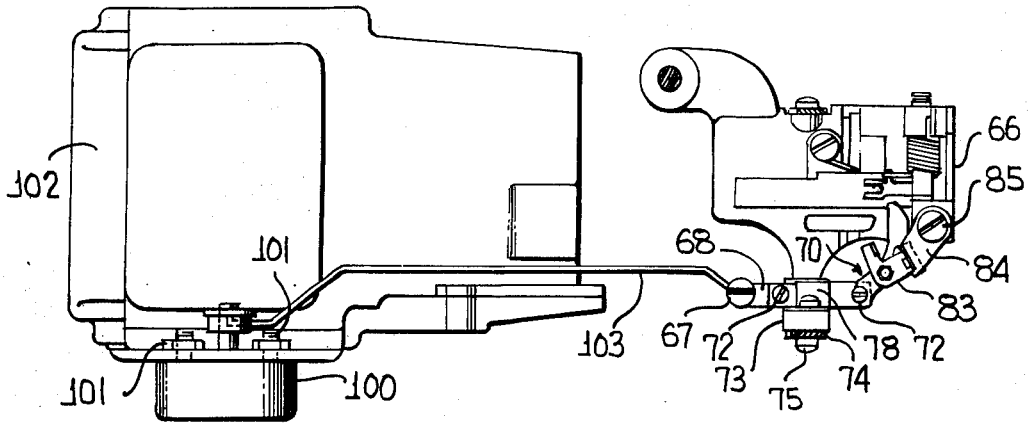
FIG. 15 is a partial top plan view of FIG. 14 with parts broken away and shown in section showing the modified form of thread cutter actuating mechanism.

It is to be appreciated that the thread cutter actuating mechanism of FIGS. 1 through 13 is a mechanical one positively actuated by means of suitable linkage connected to the foot treadle. In FIGS. 14 and 15, there is illustrated a solenoid actuating version of the thread cutter. It is to be understood that the thread cutting knives 70 and 83 operate in exactly the same manner in this form of the invention, as previously described with respect to FIGS. 1 – 13. The knives, however, in this embodiment of the invention are actuated by means of a rotary solenoid 100 which is secured by nuts 101 to the outside of a head cover 102 which corresponds to the cover 64 of FIGS. 1 and 5. A rod 103 connects the solenoid 100 to the lower knife carrier plate 68 by means of the previously described screw 67. In the solenoid actuated thread cutter, while the other details of the cutter mechanism remain the same, it is possible to eliminate the torsion spring 91 which was required to act as a return means in the mechanically actuated version of the thread cutter mechanism. It is to be understood that the rotary solenoid 100 has a built-in spring to return the thread cutting mechanism to its original position. Of course, if the solenoid 100 is not provided with such a spring, then the torsion spring 91 could be utilized.

Inasmuch as the means for controlling actuation of the solenoid 100 does not constitute a part of the specific invention involved here, no attempt has been made to specifically illustrate the same. It is, however, particularly pointed out that a needle positioning system will be utilized in conjunction with the solenoid actuator for the thread cutter, the needle positioner system utilizing a synchronizer, such as the synchronizer 94 of FIG. 1. In operation of the solenoid actuator thread cutter, at the end of a line of stitching, the operator allows the foot treadle to return to its neutral position in which position the machine will stop with the needle and looper in the proper position. The operator will then heel the treadle to initiate the thread cutting cycle and an electronic system takes over and operates the solenoid 100 to actuate the knives 70 and 83 to cut the thread 77. Immediately after the thread is cut, another portion of the unillustrated electronics system operates an air cylinder (not shown) which lowers the work supporting structure, identified in FIG. 1 by the numeral 104 to facilitate removal and insertion of workpieces. In garment plants that are not equipped with compressed air systems, the lowering of the work supporting structure may be accomplished by manually actuating a knee press, which knee press could also be utilized to actuate the rod 55. With the air operated work supporting structure there is also provided an auxiliary knee switch (not shown) which is connected to the air system and allows the operator to lower the work supporting structure at any time during a sewing cycle in order to reposition the workpiece, rearrange the hem fold which is being formed, etc. As long as the operator keeps the treadle heeled, the air cylinder will keep the work supporting structure in a lowered position. Once a new workpiece has been properly loaded into the machine, the operator allows the treadle to return to its neutral position with the result that the work supporting structure now raises to its original position and the machine is ready for the next sewing operation.

Although only one embodiment of knife arrangement and only two means for actuating the same have been specifically illustrated and described herein, it is to be understood that minor variations may be made in the thread cutting mechanism, without departing from the spirit of the invention, as defined by the appended claims.

What is claimed as new:

1. A thread cutting attachment for use in combination with a single thread blindstitch sewing machine of the type having a needle, a looper and a presser foot with the looper being of the type for isolating a portion of a thread for freedom of access thereto, said thread cutting attachment comprising a pair of blades, means interconnecting said blades for cooperative movement in unison and in opposite directions relative to an isolated thread portion in a true scissor action with both blades moving towards the isolated thread portion to sever it, and mounting means mounting said blades relative to a sewing machine to cut such thread.

2. A thread cutting attachment for use in combination with a single thread blindstitch sewing machine of the type having a needle, a looper and a presser foot with the looper being of the type for isolating a portion of a thread for freedom of access thereto, said thread cutting attachment comprising a pair of blades, means interconnecting said blades for cooperative operation in a scissor-like action to sever an isolated thread portion, and mounting means for mounting said blades relative to a sewing machine to cut such thread, said mounting means being particularly constructed for mounting on the presser foot.

3. A thread cutting attachment for use in combination with a single thread blindstitch sewing machine of the type having a needle, a looper and a presser foot with the looper being of the type for isolating a portion of a thread for freedom of access thereto, said thread cutting attachment comprising a pair of blades, means interconnecting said blades for cooperative operation in a scissor-like action to sever an isolated thread portion, and mounting means for mounting said blades relative to a sewing machine to cut such thread, said mounting means including means for pivotally mounting one of said blades and reciprocably mounting the other of said blades, and said means interconnecting said blades being operable to move one of said blades upon the movement of the other of said blades.

4. The thread cutting attachment of claim 3 together with a remote actuator connected to the last mentioned blade for effecting movement thereof.

5. The thread cutting attachment of claim 4 wherein said remote actuator is in the form of a solenoid.

6. The thread cutting attachment of claim 4 wherein said remote actuator is in the form of a cam and follower, said follower being connected to said last mentioned blade and being positioned for driving by said cam.

7. The thread cutting attachment of claim 6 wherein said follower is mounted for generally straight-line movement and said cam is mounted for arcuate movement away from said follower wherein after a predetermined initial movement of said cam said follower is released.

8. The thread cutting attachment of claim 7 wherein said follower is pivotally mounted and said cam includes a cam surface for effecting camming of said released follower to an out of the way position in response to the return of said cam to again operatively associate said cam and follower.

9. The thread cutting attachment of claim 6 together with means for connecting said cam to an operator actuated control for movement thereby.

10. The thread cutting attachment of claim 4 together with means for selectively rendering said remote actuator inoperative in accordance with the position of an associated sewing machine.

11. The thread cutting attachment of claim 3 wherein said blades are horizontally disposed.

12. The thread cutting attachment of claim 3 wherein said means interconnecting said blades includes a slot in said other blade and a pivotal connector between said blades passing through said slot wherein straight line movement of said other blade results in pivotal movement of said one blade.

13. In combination with a single thread blindstitch sewing machine of the type including a looper and a presser foot with the looper having means for isolating a portion of a thread for freedom of access thereto, a thread cutting attachment for cutting thread carried by said looper, said thread cutting attachment including a pair of blades, means interconnecting said blades for cooperative movement in unison and in opposite directions relative to a thread isolated by said looper in a true scissor action with both blades moving towards the isolated thread portion to sever it, and mounting means for mounting said blades adjacent said looper for cooperation therewith in the sewing of a thread.

14. In combination with a single thread blindstitch sewing machine of the type including a looper and a presser foot with the looper having means for isolating a portion of a thread for freedom of access thereto, a thread cutting attachment for cutting thread carried by said looper, said thread cutting attachment including a pair of blades, means interconnecting said blades for cooperative operation in a scissor-like action to sever a thread portion isolated by said looper, and mounting means for mounting said blades adjacent said looper for cooperation therewith in the sewing of a thread, said mounting means being carried by said presser foot.

15. The combination of claim 14 wherein said looper thread isolating means includes a pair of spaced fingers and said blades cooperate to cut a thread extending between said looper fingers.

16. The combination of claim 13 together with a remote actuator for said blades remotely mounted on said sewing machine and wherein said actuator includes a stop, said sewing machine includes a drive shaft carrying a plate having a notch therein, and said machine having drive means coordinated with said notched plate to align said notch with said stop only when said looper is in position holding a thread for cutting by said blades.

17. The combination of claim 13 wherein said mounting means include means for pivotally mounting one of said blades and reciprocably mounting the other of said blades and said means interconnecting said blades including a slot in said other blade and a pivotal connector between said blades passing through said slot wherein straight line movement of said other blade results in pivotal movement of said one blade.

* * * * *